United States Patent [19]

Hammelmann

[11] 4,173,435

[45] Nov. 6, 1979

[54] PLUNGER PUMP

[75] Inventor: Paul Hammelmann, Oelde, Fed. Rep. of Germany

[73] Assignee: Paul Hammelmann Maschinenfabrik, Oelde, Fed. Rep. of Germany

[21] Appl. No.: 786,041

[22] Filed: Apr. 7, 1977

[30] Foreign Application Priority Data

Apr. 9, 1976 [DE] Fed. Rep. of Germany ..... 2615531

[51] Int. Cl.[2] ..... F04B 19/02; F04B 21/00

[52] U.S. Cl. ..... 417/469; 417/539; 417/457; 417/559

[58] Field of Search ..... 417/469, 457, 900, 539, 417/559; 74/182

[56] References Cited

U.S. PATENT DOCUMENTS

| | | | |
|---|---|---|---|
| 214,764 | 4/1879 | Fagan | 74/18.2 |
| 2,756,679 | 7/1956 | Meader | 417/900 |
| 2,983,480 | 5/1961 | Greenlie | 74/18.2 |
| 3,435,733 | 1/1969 | Enke | 74/18.2 |
| 4,024,770 | 5/1977 | Liesenborghs | 74/18.2 |
| 4,036,564 | 7/1977 | Richards. | |

FOREIGN PATENT DOCUMENTS

| | | | |
|---|---|---|---|
| 2411546 | 9/1975 | Fed. Rep. of Germany | 417/457 |
| 880453 | 3/1943 | France | 417/469 |
| 1462145 | 1/1977 | United Kingdom | 417/469 |

*Primary Examiner*—William L. Freeh
*Attorney, Agent, or Firm*—Michael J. Striker

[57] ABSTRACT

A plunger pump includes a pump housing and a plunger extending into a pumping chamber of the pump housing. A sleeve valve is mounted only on the plunger for reciprocation therewith and also for displacement longitudinally of the plunger and subdivides the pumping chamber, when in its closed position, into a suction space without, and pressure space within, the sleeve valve. An inlet communicates with the suction space, and an outlet with the pressure space, the latter having a one-way valve therein which opens during the pumping stroke of the plunger. A flexible diaphragm ring extends across a spacing between the pump housing and the sleeve valve and is sealingly connected to these components. The diaphragm ring is flexible and urges the sleeve valve toward its closed position. A liquid seal may be accommodated in a compartment separated from the suction space by the diaphragm ring.

10 Claims, 4 Drawing Figures

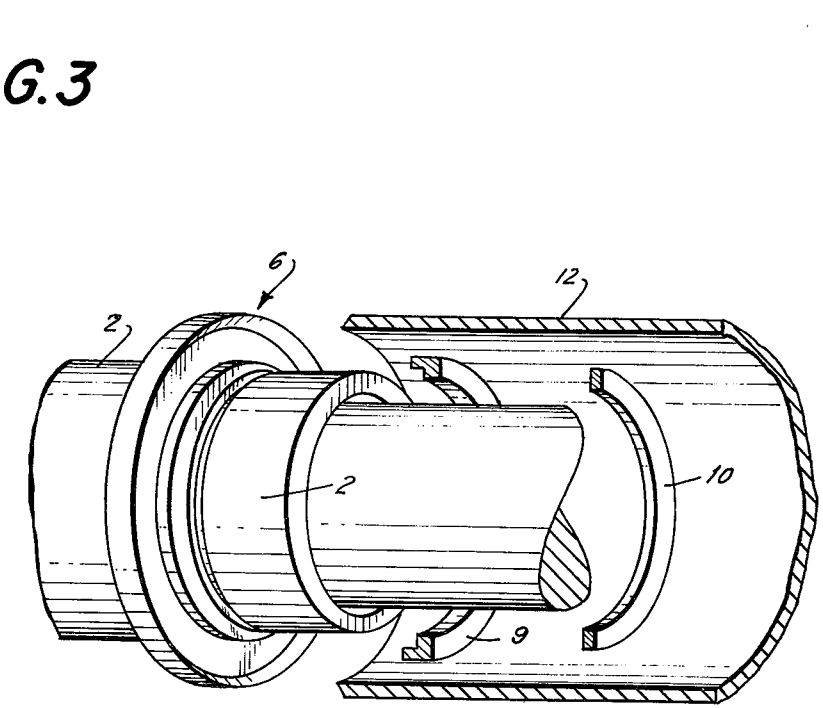
FIG. 4
FIG. 3
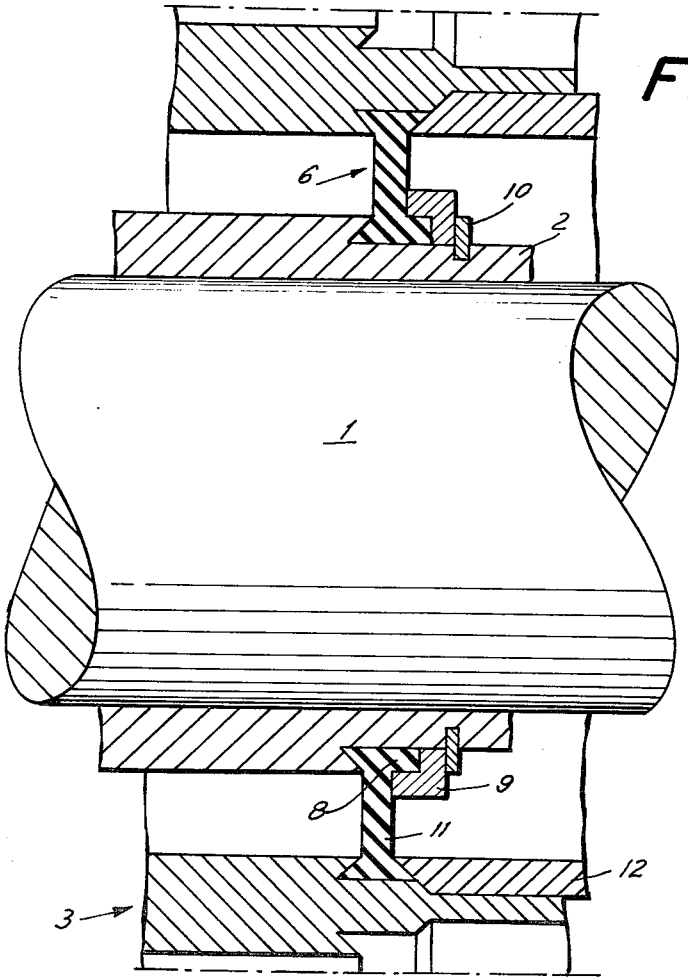

PLUNGER PUMP

BACKGROUND OF THE INVENTION

The present invention relates to pumps in general, and more particularly to plunger-type pumps.

Pumps of different constructions and working according to different principles, have already been developed and are in widespread use. Their constructions will vary in accordance with the requirements which such pumps have to satisfy, such as the properties of the medium to be pumped, the volume to be pumped by the pump in time unit, whether the pumping action must be continuous or may be intermittent, and the pressure differential to be generated by the pump, to name just a few.

There has also been proposed a plunger-type pump in which a pump housing defines a pumping chamber, and an elongated plunger is accommodated in the pumping chamber and reciprocates in the pump housing. The introduction of the medium to be pumped into, and discharge of such medium from, the pumping chamber is controlled by valves both at the inlet side and on the outlet side of the pump. A particularly simple construction and a reliable operation of this type of pump are obtained when the inlet-side valve is constructed as a sleeve valve mounted on and surrounding the plunger. The sleeve valve, to a limited extent, is entrained by the plunger for joint reciprocation therewith, against a force of a biasing spring acting upon the sleeve valve and urging the same toward a closing position thereof. In the latter position, the sleeve valve subdivides the pumping chamber into a suction space containing low-pressure medium and surrounding the sleeve valve, being in communication with the inlet port, and a pressure space in which the medium is pressurized during the pumping stroke of the plunger and from which it is discharged into the outlet port upon the opening of the one-way valve at the outlet side of the pump.

While this particular type of a pump has many advantages, it is also possessed of several drawbacks. Fist of all, such a pump can be used for pumping only certain media, particularly such which are not overly toxic, noxious or aggressive, while it is not suited for pumping media which tend to form deposits or encrustations at relatively calm regions of the pump, which tend to attack and corrode or erode the materials of the various components of the pump, or which could create a hazardous condition if permitted to escape from the pump to the exterior thereof. Another disadvantage of a pump of this construction is that it is very difficult, if not impossible, to achieve hermetic sealing of the pump, and that the seals employed heretofore were, for this rason, necessarily very complex, and therefore expensive.

SUMMARY OF THE INVENTION

Accordingly, it is a general object of the present invention to avoid the disadvantages of the prior art.

More particularly, it is an object of the present invention to so construct the pump of the above-mentioned type as to be capable of pumping even noxious or aggressive fluid media.

Yet another object of the present invention is to design such pump in such a manner that the danger of escape of such a fluid media to the exterior of the pump housing is avoided.

A concomitant object of the present invention is to so construct the pump as to be simple, inexpensive to manufacture, easy to assemble and reliable in operation. In pursuance of these objects and others which will become apparent hereafter, one feature of the present invention resides, briefly stated, in a pump which comprises, in combination, a pump housing defining a pumping chamber and having an end wall; an elongated plunger at least partly accommodated in the pumping chamber and mounted in the pump housing for reciprocation longitudinally thereof toward and away from the end wall of the pump housing between a retracted and an extended position; a sleeve valve surrounding a portion of the plunger and mounted thereon for displacement longitudinally of the plunger and for limited reciprocation therewith between a first position in which the sleeve valve is spaced from the end wall of the pump housing, and a second position in which the sleeve valve sealingly abuts the end wall of the pump housing and subdivides the pumping chamber into a suction space around the sleeve valve and a pressure space within the sleeve valve; an inlet port communicating with the suction space; an outlet port communicating with the pressure space in the second position of the sleeve valve; a one-way valve in the outlet port which opens when the plunger moves toward the extended position thereof and the sleeve valve is in the second position thereof for discharging pressurized medium from the pressure space into the outlet port; and means for urging the sleeve valve toward the second position thereof and for sealing the suction space, including a diaphragm ring extending between and sealingly connected to the sleeve valve and to the pump housing. Preferably, the outlet port is coaxial with the plunger. Advantageously, means is provided in the pump housing for limiting the extent of reciprocation of the sleeve valve with the plunger. The sleeve valve is advantageously mounted on the plunger, while the pump housing surrounds the sleeve valve with a spacing therefrom and the diaphragm ring extends across such spacing.

The diaphragm ring, in order to be able to urge the sleeve valve toward the second position thereof, is made of any conventional resiliently yieldable material of any type, such as, for instance, natural or synthetic rubber or the like. The diaphragm ring delimits the suction space of the pumping chamber at one axial end thereof. As a result of this, all the surfaces bounding the suction space are smooth and flat and the walls having such surfaces do not have any undercuts, offsets, recesses, projections or the like at which contaminants or bacteria could accumulate.

According to a further concept of the present invention, the diaphragm ring subdivides the spacing between the pump housing and the sleeve valve into the above-mentioned suction space and an enclosed space for a fluid seal. The pressure of the fluid seal present in the enclosed space need only correspond to the pressure prevailing in the inlet conduit of the pump, while the pressure of the fluid seal when used in conventional constructions of pumps of this type must equal the working pressure of the pump. This results in a pronounced economical advantage.

In a currently preferred embodiment of the present invention, the diaphragm ring is sealingly connected to the front half of the sleeve valve, that is, the half of the sleeve valve which is close to the end wall of the pump housing.

According to a very advantageous concept of the present invention, the diaphragm ring has an L-shaped cross-section and includes one arm parallel to the elongation of the plunger and sealingly connected to the sleeve valve, and another arm extending from the one arm toward the pump housing and having an end portion in sealing contact with the latter. Advantageously, the pump housing has a circumferentially extending groove, and the end portion of the other arm of the diaphragm ring is sealingly received in this groove. To obtain excellent sealing results at the pump housing, the groove may be undercut, and the above-mentioned end portion of the other arm of the diaphragm ring may have a dove-tailed cross section to engage in such an undercut groove.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG, 3 is a partly sectioned view taken along the line II—II in FIG. 1, on an enlarged scale; and FIG. 4 is an exploded perspective partly sectioned view of a part of the pump.

DETAILED DISCUSSION OF THE PREFERRED EMBODIMENTS

Figure 1:
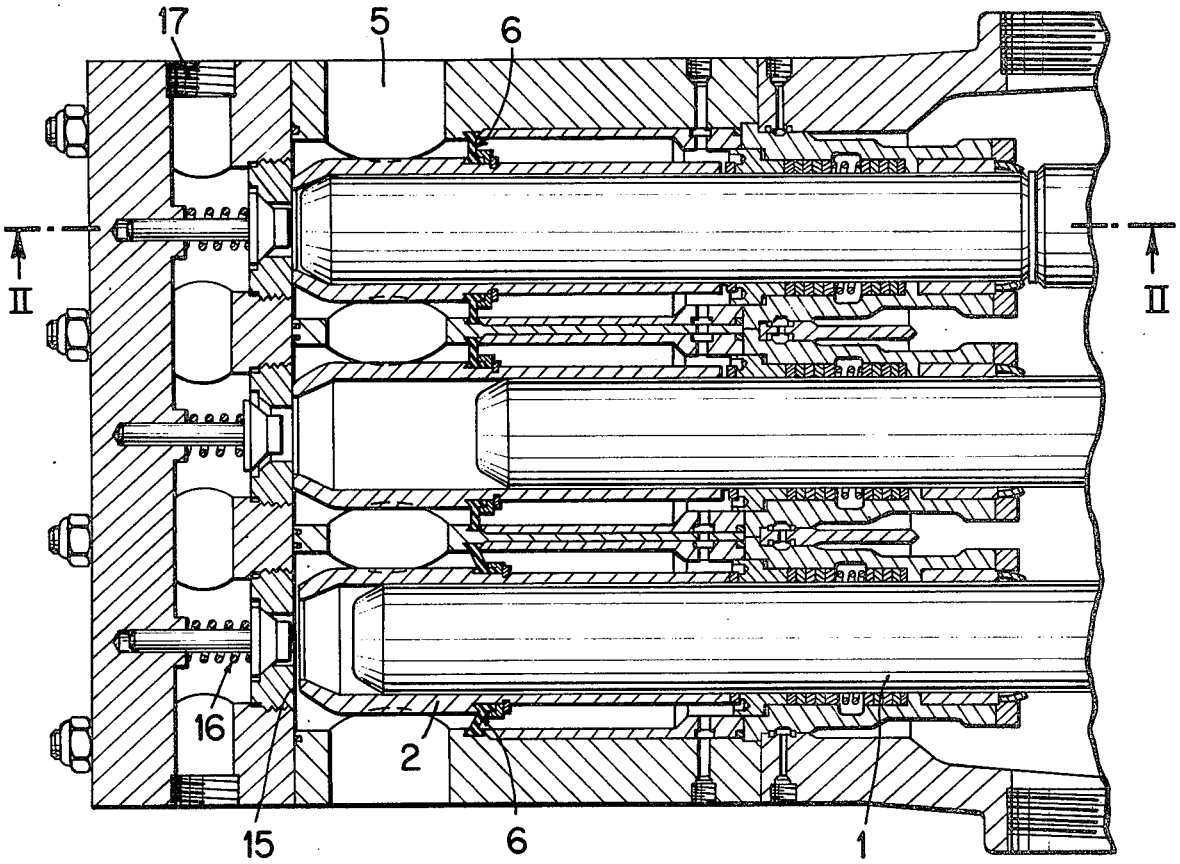
FIG. 1 is a sectional view of a pump having three pumping devices embodying the present invention.

Referring now to the drawings, it may be seen therein that the pump of the present invention includes a plunger 1, on which there is slidably mounted a sleeve valve 2, the inner space of which constitutes the pressure space of the pump. A pump housing or pump cylinder 3 surrounds the sleeve valve 2 with a spacing therefrom so that a suction space 4 is present between the sleeve valve 2 and the pump housing 3. A port 5 opens into the suction space 4 and is also in communication with a non-illustrated conventional conduit through which a medium to be pumped is introduced into the inlet port 5 and through the same into the suction space 4.

The suction space 4 is delimited at one of its axial sides by a diaphragm ring 6 which is of a resiliently yieldable material and which is fluid-tightly and sealingly connected to the sleeve valve 2, on the one hand, and to the pump housing 3, on the other hand.

In the illustrated embodiment of the present invention, the diaphragm ring 6 has an L-shaped cross-section and includes an arm 8 which extends parallel to the longitudinal axis 7 of the plunger 1. The arm 8 is sealingly connected to the sleeve valve 2 (see FIG. 3) by means of an L-shaped connecting ring 9 and a springy arresting ring 10 (see FIGS. 3 and 4). The arm 8 has a dovetailed configuration at its side which faces toward a shoulder of the sleeve valve 3, and is received in a correspondingly configurated recess of the sleeve valve 3 (see FIG. 3).

The L-shaped diaphragm ring 6 further has another arm which extends transversely of the above-mentioned arm 8, the other arm 11 having a radially outward end portion which is of dovetailed configuration. The pump housing 3 has a circumferential groove also of a dovetailed configuration and the above-mentioned end portion of the arm 11 is matingly received in such a groove. The end portion of the arm 11 is held in this groove and in sealing contact with the pump housing 3 by means of a sleeve 12.

The diaphragm ring 6, in addition to delimiting the suction space 4, also separates the latter from an annular enclosed space 13. The annular enclosed space 13 can serve the purpose of accommodating a fluid seal.

The plunger 1 has a portion which extends from the interior to the exterior of the pump housing 3, and the annular enclosed space 13 is sealed in relation to the plunger 1 at this portion by means of a packing seal or stuffing box 14 of well-known construction.

Figure 2:
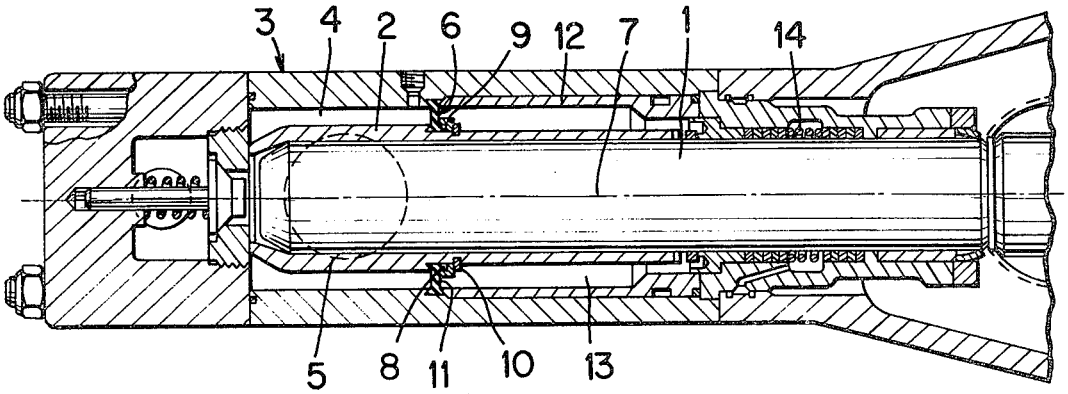
FIG. 2 is a sectional view taken on line II—II of FIG. 1.

The diaphragm ring 6 constitutes a return spring for the sleeve valve 2 which has a tendency to hold the sleeve valve 2 in, or return the same to, the position illustrated in FIG. 2. Having so discussed the construction of the pump of the present invention, the various stages of the operation thereof will now be briefly discussed in connection with FIG. 1 in which the three plungers of the pump illustrated therein are in positions corresponding to different phases of the operation of each plunger 1.

FIG. 1 illustrates that the lower plunger 1 has just commenced its displacement from the extended toward the retracted position thereof in the suction stroke. The piston or plunger 1 entrains the sleeve valve 2 for joint limited displacement therewith. Simultaneously therewith, the diaphragm ring 6 is elastically deformed so that it exerts a return force on the sleeve valve 2, biasing the same in direction toward a valve seat 15 for the sleeve valve 2.

The central plunger 1 in FIG. 1 has just achieved its retracted position during the suction stroke. The diaphragm ring 6 has already displaced the sleeve valve 2 into its closing position in which it contacts the valve seat 15, so that the central pumping arrangement is ready for the performance of the pumping stroke by the plunger 1 thereof.

The upper pumping arrangement of FIG. 1 is in the position assumed at the end of the pumping stroke and prior to the beginning of the suction stroke, that is, the plunger 1 is in its extended position.

A one-way valve 16 is associated with each plunger 1 or with each sleeve valve 3. This one-way valve 16 opens when the plunger 1 conducts its pumping stroke from its retracted to its extended position, and admits the pressurized fluid into a discharge conduit 17.

In the example of the embodiment of the present invention which is illustrated in the drawings, the diaphragm ring 6 is arranged in the region of the front half of the sleeve valve 2, that is in the region of that half of the sleeve valve 2 which is closer to the wall in which the one-way valve 16 is mounted.

The sleeve valve 3 is surrounded, on the one hand, by the suction space 4 and, on the other hand, by the annular enclosed space 13 accommodating the fluid seal. The medium present in the suction space 4, as well as the fluid seal present in the annular enclosed space 13, serve to cool the sleeve valve 2 so that the thermal loading of the pump is kept to a minimum.

It will be understood that each of the elements described above, or two or more together, may also find a useful application in other types of constructions differing from the types described above.

While the invention has been illustrated and described as embodied in a plunger-type pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of proir art, fairly constitute essential characteristics of the generic or specific aspects of this invention.

What is claimed as new and desired to be protected by Letters Patent is set forth in the appended claims.

1. A pump comprising, in combination, a pump housing defining a pumping chamber and having an end wall; an elongated plunger at least partly accommodated in said pumping chamber and mounted in said pump housing for reciprocation longitudinally thereof toward and away from said end wall of said pump housing between a retracted and an extended position; a sleeve valve surrounding a portion of said plunger and mounted thereon for displacement longitudinally of said plunger and for limited reciprocation therewith between a first position in which said sleeve valve is spaced from said end wall of said pump housing, and a second position in which said sleeve valve sealingly abuts said end wall of said pump housing and subdivides said pumping chamber into a suction space around said sleeve valve and a pressure space within said sleeve valve; an inlet port communicating with said suction space; an outlet port communicating with said pressure space in said second position of said sleeve valve; a one-way valve in said outlet port which opens when said plunger moves toward said extended position thereof and said sleeve valve is in said second position thereof for discharging pressurized medium from said pressure space into said outlet port; and at least one resilient sealing member so extending between and sealingly connected to said sleeve valve and to said pump housing as to simultaneously permanently urge said sleeve valve toward said second position thereof and seal said suction space.

2. A combination as defined in claim 1, and further comprising means in said pump housing for limiting the extent of reciprocation of said sleeve valve with said plunger.

3. A combination as defined in claim 1, wherein said sleeve valve is mounted only on said plunger.

4. A combination as defined in claim 1, wherein said outlet port is coaxial with said plunger.

5. A combination as defined in claim 1, wherein said pump housing surrounds said sleeve valve with a spacing therefrom; and wherein said sealing member is a diaphragm ring which extends across said spacing.

6. A combination as defined in claim 5, wherein said diaphragm rinfg subdivides said spacing between said pump housing and said sleeve valve into said suction space and an enclosed space for a fluid seal.

7. A combination as defined in claim 5, wherein said sleeve valve has a front half close to, and a rear half remote from, said end wall; and wherein said diaphragm ring is sealingly conncted to said front half of said sleeve valve.

8. A combination as defined in claim 1, wherein said sealing member is a diaphragm ring which haa an L-shaped cross section and includes one arm parallel to the elongation of said plunger and sealingly connected to said sleeve valve, and another arm extending from said one arm toward said pump housing and having an end portion in sealing contact with the latter.

9. A combination as defined in claim 8, wherein said pump housing has a circumferentially extending groove; and wherein said end portion of said other arm of said diaphragm ring is sealingly received in said groove.

10. A combination as defined in claim 9, wherein said groove is undercut; and wherein said end portion of said other arm of said diaphragm ring has a dovetailed cross section to engage in said undercut groove.

* * * * *